US007381068B1

(12) United States Patent
Lin et al.

(10) Patent No.: US 7,381,068 B1
(45) Date of Patent: Jun. 3, 2008

(54) RECEPTACLE CONNECTOR

(75) Inventors: Chia-wen Lin, Tu-Cheng (TW); Shu-man Chiang, Tu-Cheng (TW); Chung-hsin Huang, Tu-Cheng (TW); Mei-chuan Yang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/826,047

(22) Filed: Jul. 12, 2007

(51) Int. Cl.
*H01R 13/44* (2006.01)

(52) U.S. Cl. ..... 439/136

(58) Field of Classification Search ..... 439/138, 439/135–136, 142, 148–149, 892–893, 141, 439/144, 680; 361/684, 801, 802, 726, 759, 361/737, 752, 730, 728
See application file for complete search history.

(56) References Cited

U.S. PATENT DOCUMENTS 7,223,108 B2 * 5/2007 Chiang et al. ..... 439/137
2002/0058432 A1 * 5/2002 Chen et al. ..... 439/142
2004/0229484 A1 * 11/2004 Uchida ..... 439/137

* cited by examiner

*Primary Examiner*—Edwin A León
(74) *Attorney, Agent, or Firm*—Rosenberg, Klein & Lee

(57) ABSTRACT

A receptacle connector includes a dielectric housing and a dustproof cover covered on the housing. The housing has a bottom wall, a top wall, two sidewalls and two retainers defined between the sidewalls. Two locking grooves formed at the opposite sides of the body are defined between one of the sidewalls and the corresponding retainers. Each sidewall defines a position unit in the middle thereof with a guide unit formed in front of the position unit. The dustproof cover has a plate, two receiving grooves and two fixed arms. Each fixed arm defines a guide portion extending inward from the end thereof with two abutting blocks protruding inward from inner side of each fixed arms. The guide portions are sliding received in the position units along the guide unit. The abutting blocks are received between the position unit and the guide unit and pressed against the guide unit.

2 Claims, 5 Drawing Sheets

RECEPTACLE CONNECTOR

BACKGROUND OF THE INVENTION

1. Field of the Invention

The present invention relates to a receptacle connector, and more particularly to a dustproof receptacle connector.

2. The Related Art

Electronic products are widely used more and more with the development of the technology of the electrons. Connectors are also widely used with the development of the technology of the electrons. However, terminals of the connector are easily to be dirtied and degraded by the dust. So, a dustproof receptacle connector is needed urgently.

A conventional dustproof receptacle connector includes a body, a plurality of terminals received in the body and a housing overlaid about the body. The body has a receiving portion. Each terminal received in the receiving portion has a first contact portion and a second contact portion. The housing has a cavity to receive the body. A Printed Circuit Board is inserted into the housing to contact with the second contact portion. A plug is inserted into the housing to contact with the first contact portion for transmitting signals between the plug and the receptacle connector. The plug further comprises a locking apparatus to mate with two locking grooves of the housing for fixing the plug in the housing firmly.

However, each of the locking grooves has an unlocked hatch. The dust can enter in the housing through the hatch to adhere to the terminals and other components that contact with the terminals. So, the capability of the receptacle connector is degraded.

SUMMARY OF THE INVENTION

An object of the present invention is to provide a receptacle connector including a body, a plurality of terminals received in the body, a dielectric housing overlaid about the body and a dustproof cover covered on the housing. The body has a first connecting unit, a second connecting unit and a plurality of separation portions formed between the first connecting unit and the second connecting unit. A plurality of receiving troughs are formed among the separation portions, and a plurality of fillisters are defined on the second connecting unit adjacent to the receiving troughs. Two fixed troughs are respectively defined on the outer sides of the body. Each terminal has an upright first contact portion and a first connecting portion extending horizontally from the bottom of the first contact portion. The first contact portion is received in the corresponding fillister, the first connecting portion is received in the corresponding receiving trough. The housing has a bottom wall, a top wall, two sidewalls and two retainers which are defined between the sidewalls and connected with the bottom wall and the top wall to form a cavity for receiving the body and two locking grooves at two sides of the cavity. The retainers define two fixed portions respectively, each sidewall defines a position unit in the middle thereof with a guide unit formed in front of the position unit. The position unit comprises a position groove in the middle of the position unit and two position portions at the opposite sides of the position groove. The guide unit comprises a guide groove in the middle of the guide unit, with two abutting portions at the opposite sides of the guide groove. The dustproof cover has a plate, two receiving grooves at the opposite sides of the plate and two fixed arms extending outward and then rearward from the laterally opposite sides of the plate. Each fixed arm defines a guide portion extending inward from the end of the fixed arm with two abutting blocks protruding inward from inner side of each fixed arms and lying adjacent to the guide portion respectively. The guide portion is slidably received in the position unit along the guide groove. The rear portion of the guide portion is received in the position groove, and the front portion of the guide portion is partly received in the guide groove. The abutting blocks are received between the position unit and the guide unit with the rear portions thereof pressed against the abutting portions. The receiving grooves are covered on the locking grooves.

As described above, the dustproof cover is installed on the housing to keep one end of the locking grooves obturated. The design of the receptacle connector can prevent the dust entering the housing through the locking grooves.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

The exact nature of this invention, as well as other objects and advantages thereof, will be readily apparent from consideration of the following specification relating to the accompanying drawings.

Figure 1:
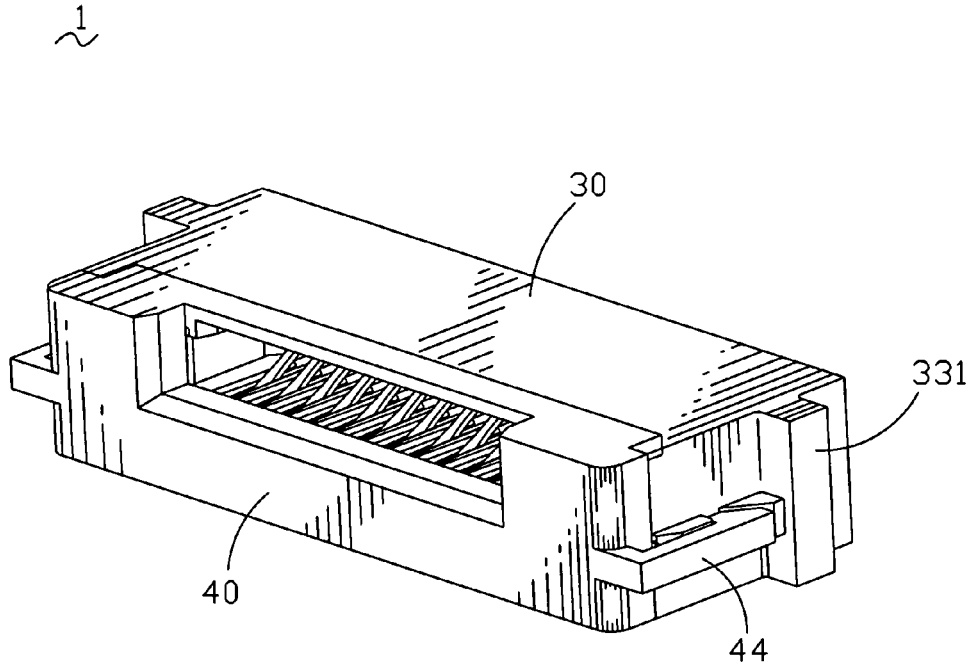
FIG. 1 is a perspective view of a receptacle connector in accordance with the present invention.
Figure 2:
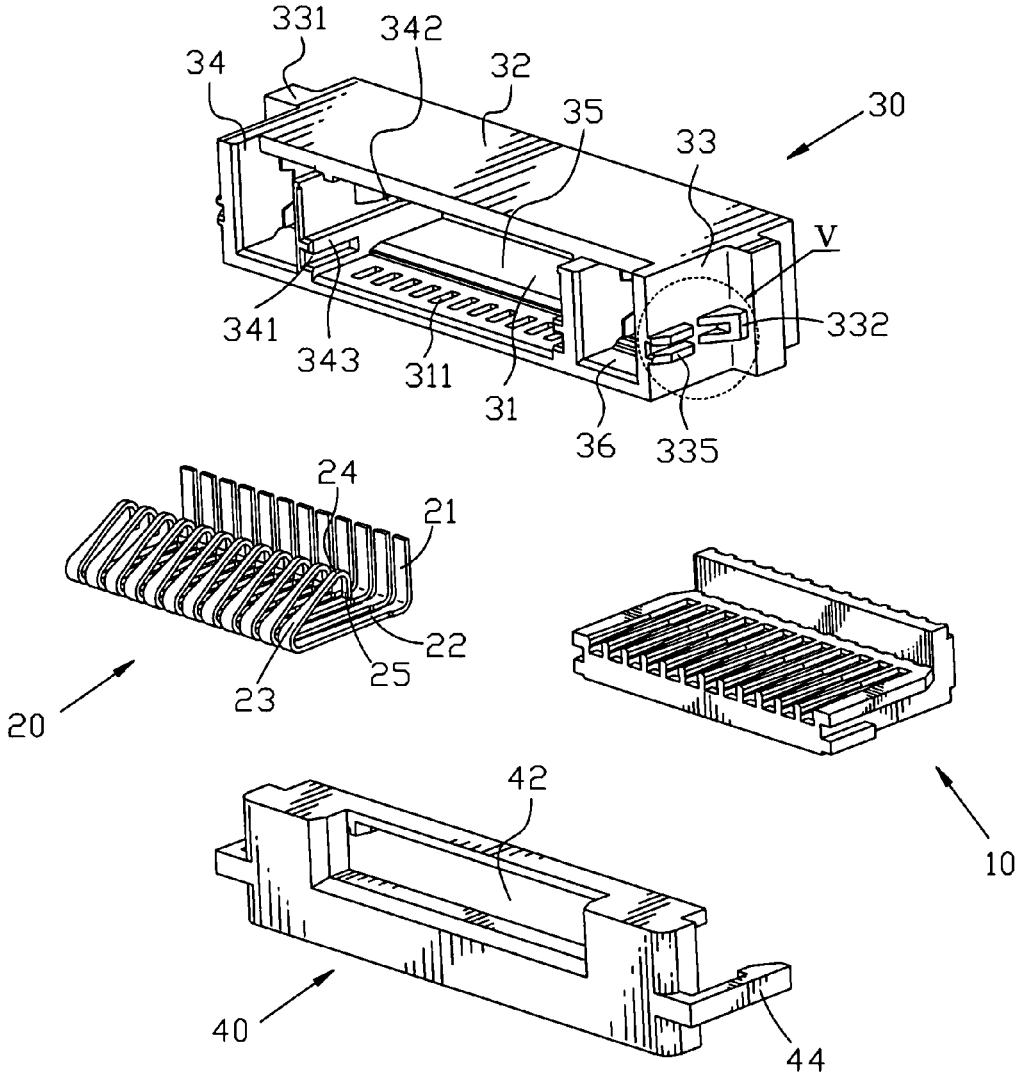
FIG. 2 is an exploded view of the receptacle connector of FIG. 1.

Please refer to FIG. 1 and FIG. 2, a receptacle connector 1 according to the present invention includes a body 10, a plurality of terminals 20 received in the body 10, a dielectric housing 30 overlaid about the body 10 and a dustproof cover 40 covered on the housing 30.

Figure 3:
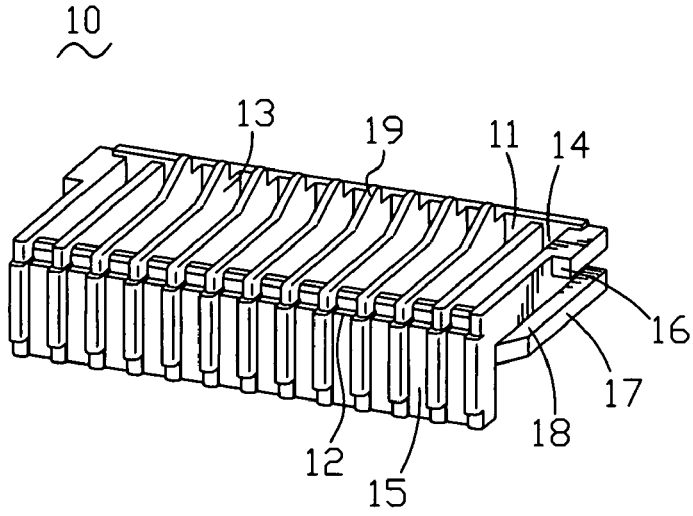
FIG. 3 is a perspective view of a body of the receptacle connector shown in FIG. 2.

Referring to FIG. 3, the body 10 which seems as barriers includes a first connecting unit 11, a second connecting unit 12 which is parallel with the first connecting unit 11 and a plurality of separation portions 13 formed between the first connecting unit 11 and the second connecting unit 12. The separation portions 13 parallel to each other. Each of the separation portions 13 defines one end connecting with the first connecting unit 11 and another end connecting with the second connecting unit 12 and extending outward to beyond the second connecting unit 12 to form a bulge. Pluralities of fillisters 15 are defined among the bulges of the separation portions 13 parallel to each other. A set of receiving troughs 14 are formed among the separation portions 13. A pair of first guide blocks 16 protrude outward from two sides of the body 10 respectively, and also two second guide blocks 17 parallel to the first guide blocks 16 protrude outward from the two sides of the body 10 and are below the first guide blocks 16. A fixed trough 18 is defined between the first guide block 16 and the second guide block 17. A bump 19 protrudes outward from the end of each separation portion 13 near to the first connecting unit 11.

Referring to FIG. 2 again, each terminal 20 has an upright first contact portion 21 in the form of a thin board, a first connecting portion 22 extending forward from the bottom of the first contact portion 21, and a second connecting portion 23 bending upward and then rearward from the end of the first connecting portion 22. The first connecting portion 22 and the second connecting portion 23 intersect at an acute angle. A second contact portion 24 bends downward from the end of the second connecting portion 23. A tail 25 extends downward from the end of the second contact portion 24. The first contact portion 21 is received in the corresponding fillister 15, and the first connecting portion 22 is received in the corresponding receiving trough 14. One part of the second contact portion 24 stretches out of the corresponding receiving trough 14

Figure 5:
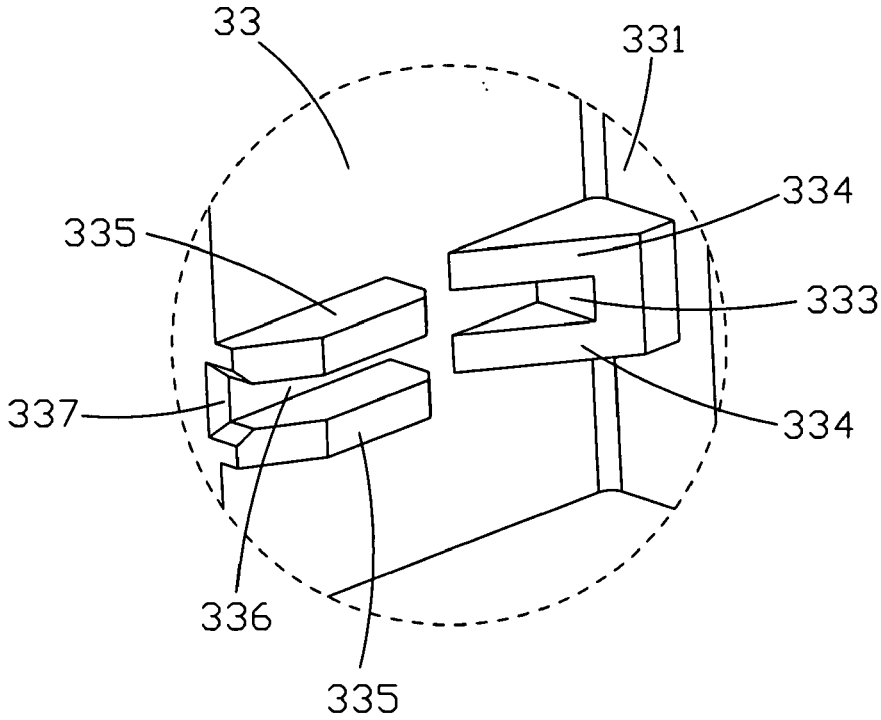
FIG. 5 is a partial enlarged view of a position unit and a guide unit of the receptacle connector labeled V shown in FIG. 2.
Figure 6:
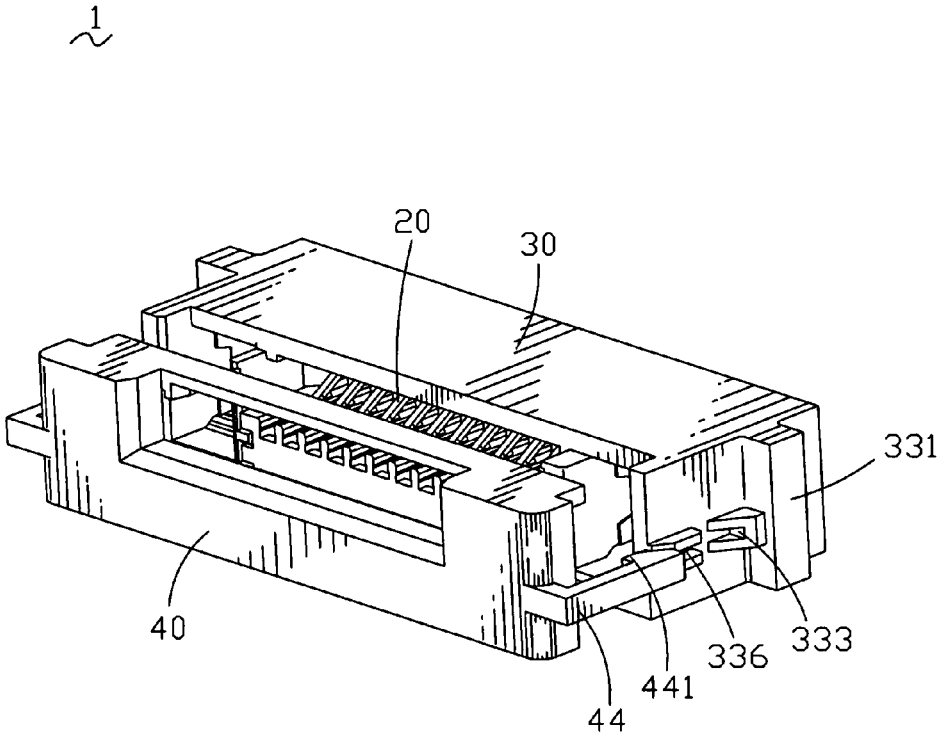
FIG. 6 is a perspective view for describing operations of the receptacle connector.

Referring to FIGS. 2,3 and FIG. 5, the housing 30 has a bottom wall 31, a top wall 32 which is parallel with the bottom wall 31, two sidewalls 33 lying between the bottom wall 31 and the top wall 32 and connecting with them. Two retainers 34 connected with the top wall 32 and bottom wall 31 are defined between the sidewalls 33 to form a cavity 35 and two locking grooves 36 at two sides of the cavity 35. The bottom wall 31 defines a plurality of locking holes 311 in the front of the bottom wall 31 for locking the corresponding bumps 19 of the body 10. Two first fixed grooves 341 and two second fixed grooves 34 communicating with the cavity 35 are defined on the corresponding retainers 34 respectively and pass through the front ends of the retainers 34. The length of the first fixed groove 341 is shorter than the length of the second fixed groove 342. The first fixed groove 341 is below the second fixed groove 342, therefore a fixed portion 343 is formed between the first fixed groove 341 and the second fixed groove 342 for guiding and fixing the corresponding first guide block 16 and second guide block 17 respectively. Two flanges 331 protrude outward from the outsides of the sidewalls 33. Each sidewall 33 defines a prismy position unit 332 adjacent to the corresponding flanges 331 in the middle of the sidewalls 33. The position unit 332 defines a position groove 333 in the middle thereof and two position portions 334 at the opposite sides of the position groove 333. An acclivitous guide unit 337 is formed in front of the position unit 332 with a guide groove 336 in the middle of the guide unit 337, and with two abutting portions 335 at the opposite sides of the guide groove 336.

The body 10 in which the terminals are mounted, are received in the cavity 35 of the housing 30. The first guide blocks 16 and the second guide blocks 17 are respectively slidably received in the first fixed grooves 341 and the second fixed grooves 342. The fixed portions 343 are received in the fixed troughs 18 of the body 10. The bumps 19 are jammed into the locking holes 311.

Figure 4:
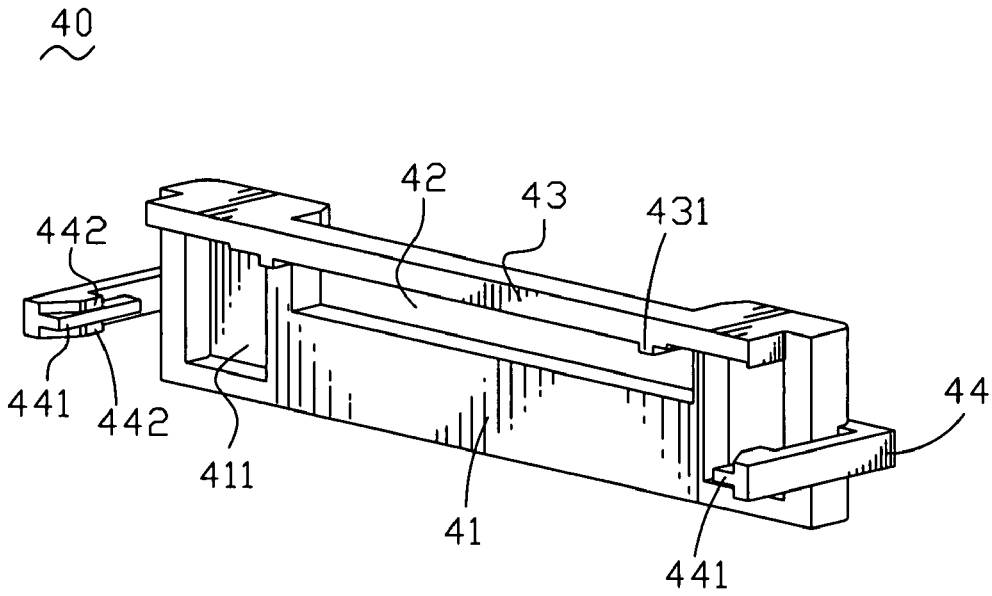
FIG. 4 is a perspective view of a dustproof cover of the receptacle connector shown in FIG. 2.

Please referring to FIG. 2 and FIG. 4, the dustproof cover 40 has a plate 41 with two receiving grooves 411 that are coupled with the locking grooves 36 and at the opposite sides of the plate 41. An insertion mouth 42 is horizontally defined between the receiving grooves 411. The length of the insertion mouth 42 is more than twice the height of the insertion mouth 42. A fixed beam 43 extends rearward from the top of the plate 41 with two position ribs 431 that protrude downward from the bottom of the fixed beam 43. The position ribs 431 intersect the plate 41 at a right angle. Two fixed arms 44 extend outward and then rearward from the laterally opposite sides of the plate 41. A guide portion 441 extends inward from the end of each fixed arm 44. Two abutting blocks 442 protrude inward from the inner side of each fixed arm 44 and lie adjacent to the guide portion 441 respectively.

Please referring to FIG. 2, 4 and FIG. 5, 6, in assembly, each guide portion 441 is slidably received in the position unit 332 along the guide groove 336 with the rear portion of the guide portion 441 received in the position groove 333, and with the front portion of the guide portion 441 partly received in the guide groove 336. The guide portion 441 abuts against the inner sides of the abutting portions 335. The abutting blocks 442 are received between the position unit 332 and the guide unit 337 with the rear portions of the abutting blocks 442 adjacent to the position portions 334, and with the front portions of the abutting blocks 442 pressed against the abutting portions 335 to fix the dustproof cover 40 firmly. Meanwhile, the fixed beam 43 is inserted into a gap formed by the top wall 32 and the sidewalls 33 with the top portion of the fixed beam 43 abutting against the bottom surface of the top wall 32. The position ribs 431 are slidable between the retainers 34 and abut against the retainers 34. The receiving grooves 411 which are covered on the locking grooves 36 prevent the housing 30 from receiving the dust. A Printed Circuit Board is inserted into the housing 30 through the insertion mouth 42 to contact with the second contact portion 24 of the terminal 20 (not shown). A plug is inserted into the cavity 35 and the locking grooves 36 for transmitting signals through another end of the housing 30 (not shown).

As described hereinabove, the receptacle connector 1 utilizes installing the dustproof cover 40 on the housing 30 to keep one end of the locking grooves 36 obturated so as to prevent the dust entering the housing 30.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector comprising:

a body having a first connecting unit, a second connecting unit and a plurality of separation portions formed between the first connecting unit and the second connecting unit, a set of receiving troughs being formed among the separation portions, a plurality of fillisters being defined on the second connecting unit adjacent to the receiving troughs, two fixed troughs being respectively defined on the outer sides of the body;

terminals, each having an upright first contact portion and a first connecting portion extending horizontally from the bottom of the first contact portion, the first contact portion being received in the corresponding fillister, the first connecting portion being received in the corresponding receiving trough;

a housing having a bottom wall, a top wall, two sidewalls and two retainers which are defined between the sidewalls and connected with the bottom wall and the top wall to form a cavity for receiving the body and two locking grooves at two sides of the cavity, the retainers defining two fixed portions respectively, each sidewall defining a position unit in the middle thereof with a guide unit formed in front of the position unit; and a dustproof cover having a plate, two receiving grooves at the opposite sides of the plate and two fixed arms extending outward and then rearward from two laterally opposite sides of the plate;

wherein the fixed portions are received in the fixed troughs of the body respectively, the position unit further comprising a position groove in the middle of the position unit and two position portions at the opposite sides of the position groove, the guide unit further comprising a guide groove in the middle of the guide unit, with two abutting portions at the opposite sides of the guide groove, each fixed arm defining a guide portion extending inward from the end thereof with two abutting blocks protruding inward from inner side thereof and lying adjacent to the guide portion respectively, the guide portion being slidably received in the position unit along the guide groove, the rear portion of the guide portion being received in the position groove, the front portion of the guide portion is partly received in the guide groove, the abutting blocks being received between the position unit and the guide unit with the rear portions thereof pressed against the abutting portions, the receiving grooves covered on the locking grooves.

2. The receptacle connector as claimed in claim 1, wherein the terminal further comprises a second connecting portion bending upward and then rearward from the end of the first connecting portion, a second contact portion bends downward from the end of the second connecting portion, a tail extends downward from the end of the second contact portion, one part of the second contact portion stretches out of the corresponding receiving troughs.

* * * * *